US007162051B2

(12) United States Patent
Grell et al.

(10) Patent No.: US 7,162,051 B2
(45) Date of Patent: Jan. 9, 2007

(54) HEADPHONE

(75) Inventors: Axel Grell, Burgdorf (DE); Konrad Hass, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 10/690,294

(22) Filed: Oct. 21, 2003

(65) Prior Publication Data

US 2004/0156521 A1 Aug. 12, 2004

(30) Foreign Application Priority Data

Oct. 21, 2002 (DE) ..... 102 49 082

(51) Int. Cl.
*H04R 25/00* (2006.01)

(52) U.S. Cl. ..... 381/372; 381/370; 381/374

(58) Field of Classification Search ..... 381/182, 381/370–374, 378, 383
See application file for complete search history.

(56) References Cited

U.S. PATENT DOCUMENTS

| | | | | |
|---|---|---|---|---|
| 4,239,945 | A * | 12/1980 | Atoji et al. | 381/371 |
| 4,429,194 | A * | 1/1984 | Kamon et al. | 381/380 |
| 4,742,887 | A * | 5/1988 | Yamagishi | 181/129 |
| 5,729,605 | A | 3/1998 | Bobisuthi et al. | |
| 5,844,998 | A * | 12/1998 | Nageno | 381/371 |
| 6,134,336 | A * | 10/2000 | Clark | 381/371 |

FOREIGN PATENT DOCUMENTS

| | | |
|---|---|---|
| DE | 197 20 396 | 11/1997 |
| DE | 101 40 663 | 1/2003 |
| EP | 0 825 796 | 2/1998 |
| JP | 1 101795 | 4/1989 |
| JP | 4-237396 | 8/1992 |
| JP | 2003-179990 | 6/2003 |

* cited by examiner

*Primary Examiner*—Curtis Kuntz
*Assistant Examiner*—P. Dabney
(74) *Attorney, Agent, or Firm*—Reed Smith LLP

(57) ABSTRACT

The invention relates to headphones. Such headphones always comprise at least one, preferably two, earpieces which are each equipped with a reproduction transducer. Furthermore, appropriate earpieces also comprise an ear cushion, which either encloses the user's ear when the headphones are put on or lies on the ear. The object of the present invention is to solve the problems of prior art arrangements and find a simple embodiment for the headphones. Headphones having at least one headphones earpiece, which comprises a reproduction system and ear cushions, the latter enclosing the ear or lying on it, a front volume and a rear volume being determined by the reproduction system, the front volume being essentially determined between the reproduction system and the volume enclosed by ear cushions and head and the rear volume being essentially the volume which is determined by the reproduction system and the housing of the headphones earpiece, the front and the rear volumes being connected by an acoustic resistor. The acoustic resistor is situated inside the housing of the headphones earpiece beneath the plane which is determined by the sound outlet aperture of the reproduction transducer.

2 Claims, 2 Drawing Sheets

HEADPHONE

CROSS-REFERENCE TO RELATED APPLICATION

This application claims priority of German Application No. 102 49 082.1, filed Oct. 21, 2002, the complete disclosure of which is hereby incorporated by reference.

BACKGROUND OF THE INVENTION a) Field of the Invention

The invention relates to headphones. Such headphones always comprise at least one, preferably two, earpieces, which are each equipped with a reproduction transducer. Furthermore, corresponding earpieces also comprise an ear cushion, which either encloses the user's ear when the headphones are put on or lies on the ear.

b) Description of the Related Art

FIG. 1 shows a known, typical embodiment of an earpiece of headphones. Here it can be seen that the headphones earpiece consists of a housing 9, which contains a dynamic transducer system 13 in which a diaphragm 2, 3 is deflected when electric signals are applied to the system so that a sound, which travels through the outlet apertures 1 of the housing to the human ear, is produced by the diaphragm 3.

The earpiece comprises an ear cushion ring 6, which encloses the ear 5 when it is put on, so that a part of the earpiece housing 7 and the ear cushion 6 is defined by the diaphragm 2, 3 and also a volume, the so-called front volume 4, is defined by the user's head and ear 5.

The space behind the diaphragm 2, 3 and the interior of the housing 9 of the headphones shell is always described as the rear volume 8.

The front volume 4 and the rear volume 8 are also connected to one another by an acousic resistor 11. The acoustic resistor 11—e.g. a layer of paper—is situated next to the ear cushion 6 in the represented example, slightly above the plane which is described by the sound outlet apertures.

Depending on how strongly the ear cushion is now pressed against the user's head, the ear cushion becomes wider and then covers the acoustic resistor 11 to a greater or lesser extent. As the degree to which the acoustic resistor is covered by the ear cushion depends on the respective adjustment pressure and this in turn depends on the head size and the setting of the headphones, an undefined covering of the acoustic resistor by the air cushion results in there being an undefined acoustic resistance between the front chamber 4 and the rear chamber 8, so that finally the sound impression is falsified.

Headphones with general characteristics as described above are known from Patent 101 40 663 which was not a prior publication. Moreover, known from DE 197 20 396 are headphones having an acoustic unit for converting an audio signal into an acoustic sound and a storage device for storing the acoustic unit, with the predetermined distance to a user's ear being retained.

OBJECT AND SUMMARY OF THE INVENTION

The primary object of the present invention is to remove the above-mentioned problems and to find a simple embodiment for it.

DESCRIPTION OF THE PREFERRED EMBODIMENTS

In accordance with the invention, headphones comprise at least one headphone earpiece having a housing. The earpiece also has a reproduction system and ear cushions, the latter enclosing the ear or lying on it, a front volume and a rear volume being determined by the reproduction system. The front volume is essentially the volume between the reproduction system and the volume enclosed by the ear cushions. The head and the rear volume are essentially the volume enclosed by the reproduction system. An acoustic resistor connects the housing of the headphone earpiece and the front and rear volumes. The acoustic resistor is situated inside the housing of the headphones earpiece with respect to the front volume behind a plane which is determined by a sound outlet aperture of the housing.

In contrast to the known prior art which has been described, in the arrangement according to the invention a setting of the low-frequency to high-frequency portion of the amplitude frequency response of headphones is achieved which does not depend on the state of the ear cushion or the pressure of the headstrap of the headphones on the head.

Figure 1:
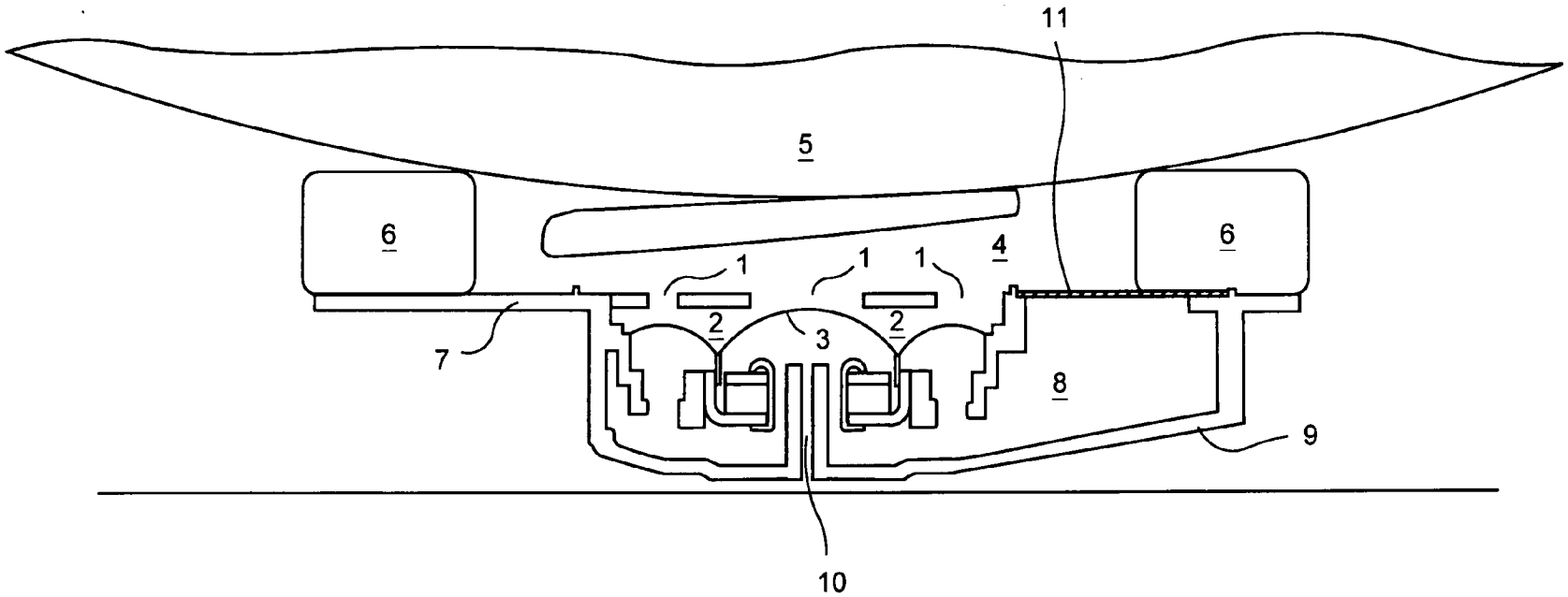
FIG. 1 illustrates a known embodiment of an earpiece of headphones.
Figure 2:
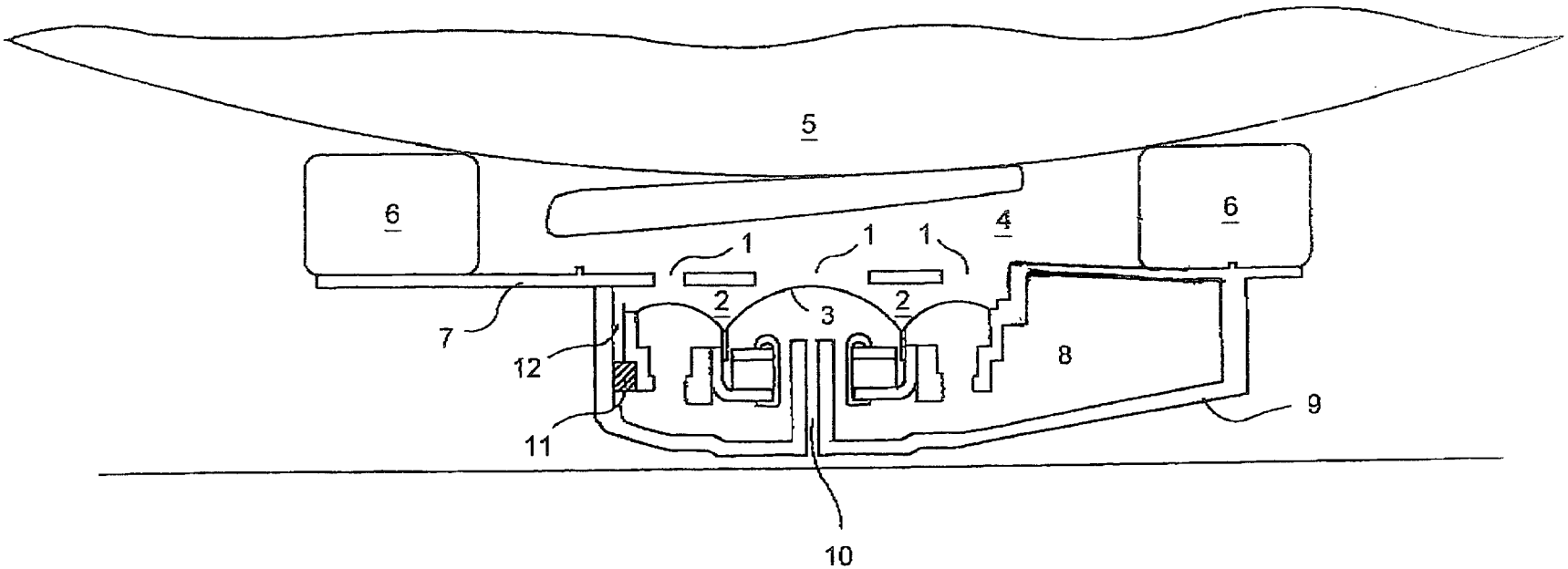
FIG. 2 illustrates an earpiece of headphones in accordance with the invention.

With the arrangement according to the invention—see FIG. 2—the acoustic resistor 11—e.g. made from paper, felt, sintered material—and thus the connection between the front and the rear volumes, lies not directly in the front volume 4, but in the volume in front of the diaphragm which is connected by the sound outlet aperture 11 of the system with the front volume and opens into it. The acoustic resistor no longer lies directly next to the ear cushions and therefore can also no longer be covered by them, depending on the different application pressure against the head. The front and rear of the diaphragm are therefore directly connected to one another by a (damped) channel 12, the cross section of which does not depend on external influences. Disposed in this channel 12 is the acoustic resistor, so that the previous problems are removed in a simple manner and the best possible sound impression is always reproduced even if the application pressure of the headphones on the user's head varies.

With the arrangement according to the invention—see FIG. 2—the acoustic resistor 11—e.g. made from paper, felt, sintered material—and thus the connection between the front and the rear volumes, lies not directly in the front volume 4, but in the volume in front of the diaphragm which is connected by the sound outlet aperture 1 of the system with the front volume and opens into it. The acoustic resistor no longer lies directly next to the ear cushions and therefore can also no longer be covered by them, depending on the different application pressure against the head. The front and rear of the diaphragm are therefore directly connected to one another by a (damped) channel 12, the cross section of which does not depend on external influences. Disposed in this channel 12 is the acoustic resistor, so that the previous problems are removed in a simple manner and the best possible sound impression is always reproduced even if the application pressure of the headphones on the user's head varies.

While the foregoing description and drawings represent the present invention, it will be obvious to those skilled in the art that various changes may be made therein without departing from the true spirit and scope of the present invention.

What is claimed is:

1. Headphones comprising:

at least one headphone ear piece having a housing, the housing having at least one sound outlet aperture, a reproduction system, an outer housing portion and ear cushions which enclose an ear of a wearer or which are lying on the ear of a wearer;

a front volume and a rear volume which are separated by the reproduction system, the front volume being the volume enclosed between the reproduction system, the ear cushions and the head of the wearer, the rear volume being the volume enclosed between the reproduction system and the outer housing portion of the housing of the headphone, wherein the front and rear volumes being connected by an acoustic resistor being situated inside a channel inside the housing of the headphones earpiece adjacent to the reproduction system, wherein the acoustic resistor is arranged inside the housing with respect to the front volume behind the plane of the sound outlet aperture of the housing and with respect to the front volume behind the plane of the reproduction system, wherein the channel connects the front and the rear volume and an exit of the channel is arranged in a volume between the reproduction system and the plane of the sound outlet aperture of the housing.

2. Headphones according to claim 1, wherein the the cross section of said channel does not depend on external influences.

* * * * *

UNITED STATES PATENT AND TRADEMARK OFFICE

CERTIFICATE OF CORRECTION

PATENT NO. : 7,162,051 B2
APPLICATION NO. : 10/690294
DATED : January 9, 2007
INVENTOR(S) : Axel Grell et al.

It is certified that error appears in the above-identified patent and that said Letters Patent is hereby corrected as shown below:

Column 4:

Claim 2, Line 1, first occurence delete "the"

Signed and Sealed this

Fifteenth Day of May, 2007

JON W. DUDAS
*Director of the United States Patent and Trademark Office*